United States Patent [19]

Luebke

[11] 4,092,011

[45] May 30, 1978

[54] LIFT MECHANISM FOR A TRUCK

[75] Inventor: Ralph C. Luebke, Memphis, Tenn.

[73] Assignee: Moore & Sons, Inc., Memphis, Tenn.

[21] Appl. No.: 803,166

[22] Filed: Jun. 3, 1977

[51] Int. Cl.[2] ..... B66F 3/22

[52] U.S. Cl. ..... 254/8 C; 254/122

[58] Field of Search ..... 254/8 C, 122

[56] References Cited

U.S. PATENT DOCUMENTS

| | | | |
|---|---|---|---|
| 2,899,172 | 8/1959 | Cresci | 254/122 |
| 3,282,566 | 11/1966 | Clarke | 254/122 |

*Primary Examiner*—Robert C. Watson

*Attorney, Agent, or Firm*—Merriam, Marshall & Bicknell

[57] ABSTRACT

This disclosure deals with a truck including a vertically movable van and a lift mechanism for raising or lowering the van. The lift mechanism includes two arms pivotally connected in a scissors configuration. The arms are also connected to the truck frame and to the frame of the van in a manner to raise or lower the van as the scissors arms are spread or closed. An extensible power unit is connected between the two arms and is operable to spread or close the arms in order to raise or lower the van. Improved reinforcements are placed on the truck frame to provide the necessary strength.

7 Claims, 6 Drawing Figures

LIFT MECHANISM FOR A TRUCK

Vertical lift trucks are commonly used in airline terminals, for example, for transporting materials, such as food, to and from the passenger cabins of aircraft. Cleanliness and sanitation require that such materials be transported in a covered van, and it is necessary for such trucks to include a lift mechanism for vertically lifting the van from ground level to the door level of the aircraft. In the case of a large jet, the van must be raised a considerable distance.

A lift mechanism commonly used in the past on such trucks is referred to as a scissors lift, and includes two arms connected between the frame of the truck and the frame of the vertically movable van. One end of one arm is pinned to the truck frame and the other end is movably connected to the van frame. Similarly, one end of the other arm is pinned to the van frame and the other end is movably connected to the truck frame. The centers of the two arms are pivotally connected together to form a scissors configuration, and an hydraulic mechanism is connected between the truck frame and one of the arms, which operates to spread the arms and thereby lift the van.

A disadvantage of the above prior art lift mechanism arises from the high mechanical stresses placed on the truck frame. The connection of the truck frame with the hydraulic mechanism is between the wheels, and the maximum moment or loading on the truck frame occurs at this point. The resulting stresses have frequently been sufficient to crack the truck frame. Another disadvantage is that, at the movable connection between the truck frame and one of the two arms, the movable end of the arm has an upward thrust on it, and it is difficult to restrain this upward thrust. Industry standards require a safety factor of three, and in practice it has been difficult to attain this factor.

It is therefore a general object of the present invention to provide an improved lift mechanism and reinforcements for a truck, which avoids the foregoing disadvantages.

A lift mechanism in accordance with this invention is designed for use with a truck including a truck frame and a vertically movable frame. The lift mechanism comprises first and second arms pivotally connected at approximately their centers to form a scissors configuration. One arm has one end pinned to the truck frame and the other end movably connected to the movable frame, and the other arm has one end pinned to the movable frame and the other end movably connected to the truck frame. The two pin connections are on one side of the pivotal connection, and the two movable connections are on the other side of the pivotal connection. An extensible drive mechanism located on one side of the pivotal connection is connected between the two arms, and it is selectively movable between extended and contracted positions. In the extended position, the arms are spread apart and the movable frame is lifted upwardly from the truck frame. In the contracted position, the arms are closed together and the movable frame is supported on the truck frame. The truck frame includes improved reinforcements for sustaining the downward thrust loads.

The foregoing and other objects and advantages of the present invention will be apparent from the following detailed description taken in conjunction with the accompanying figures of the drawings, wherein.

Figure 1:
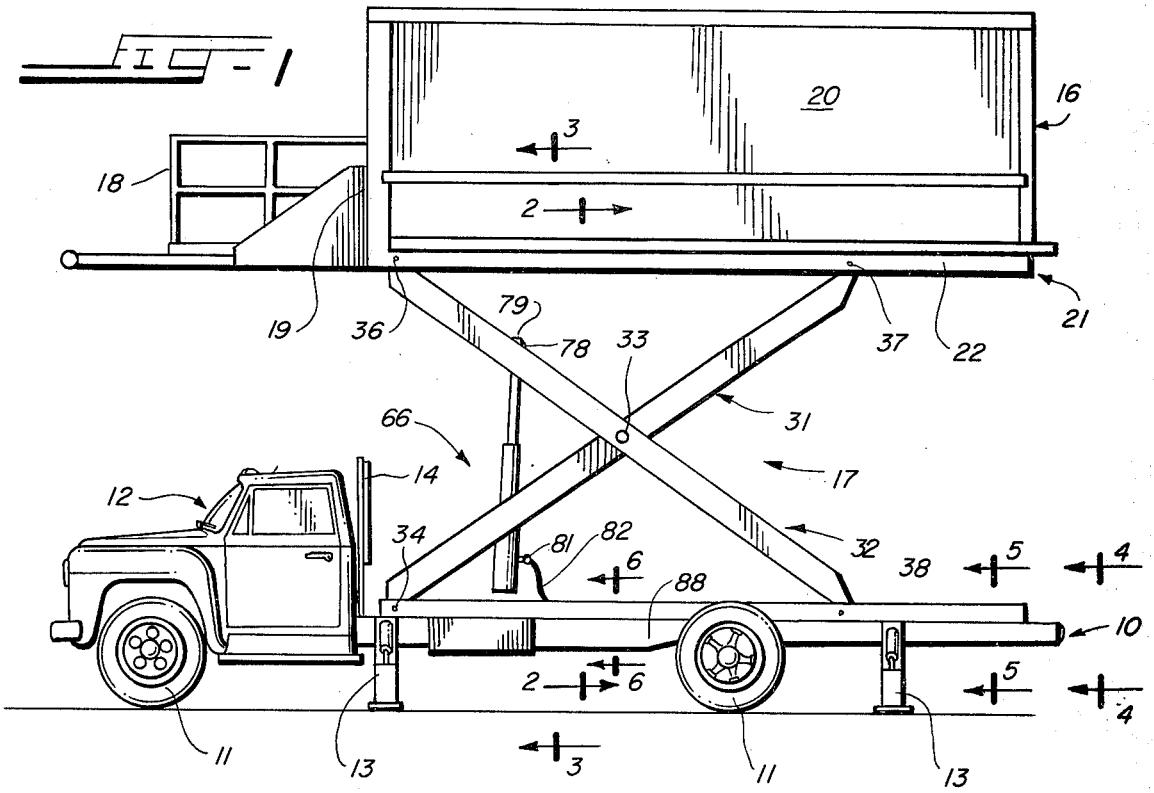
FIG. 1 is a side elevational view of a truck including a lift mechanism embodying the present invention.

While the following description and the figures of the drawing illustrate, as a specific example, a truck of the type used at an airline terminal for transporting supplies to a large jet aircraft, it should be recognized that the lift mechanism may also be used on lift trucks for other purposes. For example, the truck may include a vertically movable open frame instead of a closed van.

With specific reference to FIG. 1, the truck includes a frame 10, to be described in more detail hereinafter, that is supported by wheels 11 in a conventional manner. A cab 12 for an operator of the truck is mounted on the frame 10, and foldable outriggers 13 may be provided at the two sides of the frame. The truck frame 10 further supports a van 16 which is movably mounted above the frame 10 and behind the cab 12. A lift mechanism 17, embodying the present invention, is provided between the truck frame 10 and the van 16 in order to raise and lower the van. When the van 16 is lowered, it rests on the truck frame 10, and when it is raised, it is displaced upwardly as shown in FIG. 1. The height to which the van 16 is raised is, of course, adjustable by an operator, and the van is located to make for convenient handling of the supplies between the van and the aircraft being serviced. A platform 18 is fastened to the forward end of the van 16 for the use of an operator who, when standing on the platform 18, operates controls on a panel 19. A screen guard 14 is preferably provided between the van and the cab, and the platform 18, which is vertically movable on the van, is supported by the guard 14 when the van 21 is lowered.

The van 16 includes an enclosure 20 and a frame 21 formed by laterally spaced channels 22 and 23 (FIGS. 2 and 3) at the two longitudinally extending sides of the van. Fastened to the truck frame 10 are two longitudinally extending channels 24 and 25 which are located generally below the channels 22 and 23. Each of the C-shaped channels 22 through 25 has its opening facing laterally inwardly toward the center line of the truck.

The lift mechanism 17 is formed by two arms 31 and 32 (FIG. 1) which are pivotally connected at a center pivot 33 to form a scissors configuration. The forward end of the arm 31 is pinned or hinged to the channels 24 and 25 at a fixed pivot 34, and the forward end of the arm 32 is pinned or hinged at a fixed pivot 36 to the channels 22 and 23 of the van frame 21. The rearward end of the arm 31 is movably connected to the channels 22 and 23 at the point 37, and the rearward end of the arm 32 is movably connected to the channels 24 and 25 at the point indicated by the numeral 38. When the van 16 is raised or lowered, as will be described hereinafter, the center pivot 33, the fixed pivot 37, and the movable point 36 move upwardly or downwardly and the two points 37 and 38 move longitudinally of the truck. The van frame 21 of course remains horizontal during the vertical movement.

Figure 2:
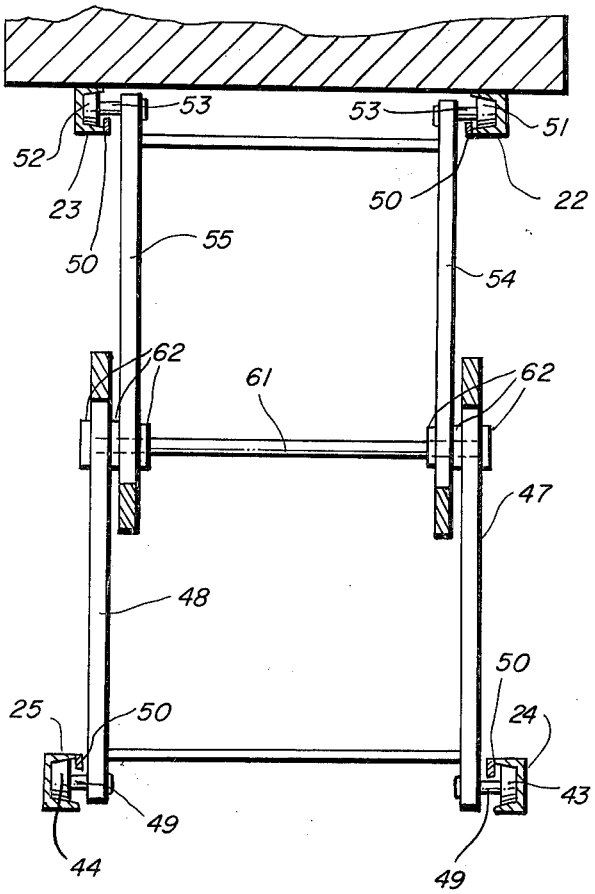
FIG. 2 is an enlarged fragmentary sectional view taken on the line 2—2 of FIG. 1.
Figure 3:
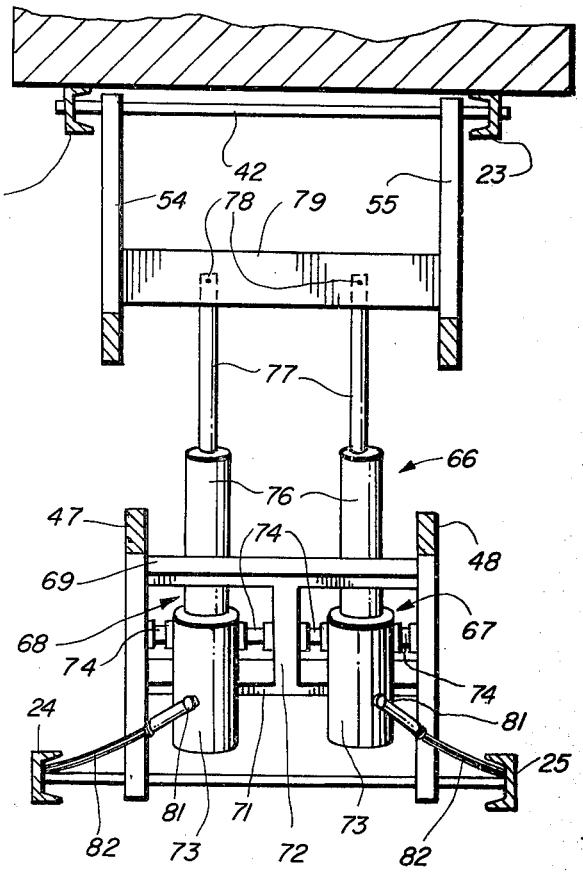
FIG. 3 is an enlarged fragmentary sectional view taken on the line 3—3 of FIG. 1.
Figure 5:
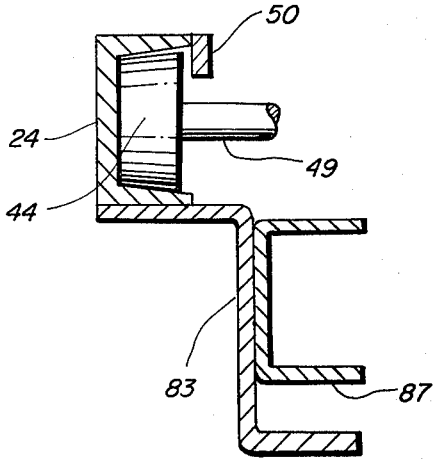
FIG. 5 is a sectional view taken on the line 5—5 of FIG. 1.

With reference first to FIG. 3, the fixed pivot 34 is formed by a rod 41 which extends laterally of the truck between the two channels 24 and 25 of the truck frame 14. Similarly, the fixed pivot 36 is formed by another rod 42 that extends laterally of the van 16 and is connected to the two channels 22 and 23. The movable pivot 38 is formed by two rollers 43 and 44 which are located between the flanges of the channels 24 and 25 (FIGS. 2 and 5). The movable point 37 is formed by two rollers 51 and 52 which are located between the flanges of the two channels 22 and 23 respectively. Bars 50 (FIGS. 2 and 5) may be secured to the channels 22 to 25 to hold the rollers in the channels.

As shown in FIG. 2, it is preferred that the outer periphery of each of the rollers 43, 44, 51 and 52 be tapered and that the inner surfaces of the flanges of the channels 24, 25, 22 and 23 be similarly tapered.

The arm 31 is formed by two parallel beams 54 and 55 (FIGS. 2 and 3), and the arm 32 is formed by two parallel beams 47 and 48. The beams 47 and 48 are mounted laterally outside the beams 54 and 55. The rods 41 and 42 extend through openings formed in the forward ends of the four beams, and suitable bearings (not shown) may be provided. The rollers 43 and 44 are connected to the rearward ends of the beams 47 and 48 by pins 49, and pins 53 connect the rollers 51 and 52 to the rearward ends of the beams 54 and 55.

The center pivot 33 between the two arms 31 and 32 is formed by a center rod 61 (FIG. 2) which extends laterally of the truck and through the four beams 47, 48, 54, and 55. Washers and fasteners 62 may be provided between the beams and on the outside surfaces of the beams to hold the parts assembled and to permit pivotal movement of the beams, and suitable bearings may also be provided.

The lift mechanism 17 further includes an extensible power unit 66 which is connected between the arms 31 and 32 and which is operable to spread or close the arms in order to raise or lower the van. In the present instance, the power unit 66 comprises a pair of hydraulic cylinders 67 and 68 which are located forwardly of the center pivot 33. The arm 31 includes two spaced apart cross braces 69 and 71 which extend laterally of the truck and are rigidly secured at their ends to the beams 47 and 48. A longitudinally extending center brace 72 connects the centers of the cross braces 69 and 71. The hydraulic cylinders 67 and 68 are located in the spaces formed between the beams 47 and 48, the cross braces 69 and 71, and the center brace 72, and the casings 73 of the hydraulic cylinders are pivotally secured between the beams 47 and 48 and the center brace 72. The pivotal mounting is indicated by the reference numeral 74. In addition to the casing 73, each of the cylinders 67 and 68 includes a piston rod which is formed by two telescoping sections rod 76 and 77. The inner of the two sections is indicated by the numeral 77 and its outer end is pivotally fastened at 78 to a cross brace 79 which extends between and is secured to the two beams 54 and 55 of the arm 31. EAch of the two hydraulic cylinders 67 and 68 is connected by a coupling 81 (FIG. 1) and a flexible hose 82 to an hydraulic motor (not shown).

Considering the operation of the lift mechanism 17, it will be apparent that when hydraulic fluid under pressure flows through the hoses 82 and the couplings 81 to the cylinders 67 and 68, the rod sections 76 and 77 will be forced out of the casings 73, and the cross brace 79 will be forced upwardly from the cross braces 69 and 71. This action will spread the forward ends of the two arms 31 and 32 apart, causing the pivot 36 to rise. The center pivot 33 also rises and the movable points 37 and 38 will move toward the left as seen in FIG. 1 and the rollers 43, 44, 51 and 52 will roll along the associated channels 24, 25, 22 and 23.

The opposite action occurs of course when the fluid pressure is reduced and the piston sections 76 and 77 are permitted to retract into the casings 73.

Figure 4:
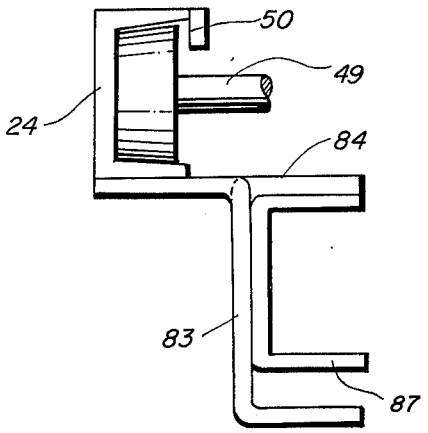
FIG. 4 is a sectional view taken on the line 4—4 of FIG. 1.
Figure 6:
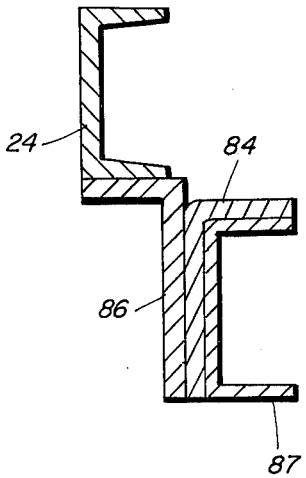
FIG. 6 is a sectional view taken on the line 6—6 of FIG. 1.

The truck frame 10 is advantageously constructed to reinforce the channels 24 and 25 as best shown in FIGS. 4 to 6. The truck frame includes a pair of C-shaped channels 87, one being located on each side of the truck. Each of the channels 87 has a change in its vertical dimension just forwardly of the rear wheels, in the area indicated by the numeral 88. The vertical dimension forwardly of the area 88 is approximately twice that rearwardly of the area 88. With reference to FIG. 5 the rearward end portion of each channel 87 is reinforced by a Z-shaped frame 83 which extends from the rear end of the channel 87 to the area 88 and terminates at the area 88. Forwardly of the area 82 is an angle 84 (FIG. 6) which overlies the upper and laterally outer surfaces of the channel 87. Coextensive with each angle 84 is an angular mounting pad 86 which is secured to the laterally outer surface of the angle 84. The horizontal flange of each frame 83 and the associated pad 86 have one of the channels 24 or 25 secured thereto. By the foregoing arrangement, the frame of the truck is reinforced sufficiently to provide a safety factor of three.

The foregoing lift mechanism and reinforced frame are highly advantageous for a number of reasons. The drive unit formed by the hydraulic cylinders does not directly engage the frame of the truck and therefore does not place any stress directly on the truck frame. The stress due to the weight of the van 16 is equally divided between the four points where the arms connect with the truck frame. These forces or thrusts on the truck frame are all in the straight downward direction, and the described reinforcement is able to withstand the forces. In addition, the outriggers 13 may be located adjacent the points 34 and 38 and thereby provide additional support in the high stress areas.

The locations of a pivotal connections between the hydraulic cylinders and the arms 31 and 32, and the length of the cylinders, is determined by the expected height to which it will be necessary to lift the van 16. For example, if it is expected that the van 16 will have to be raised a considerable distance, the hydraulic cylinders should be mounted fairly close to the center pivot 33.

What is claimed is:

1. A lift mechanism for a truck including front and rear axles, a truck frame mounted on said axles, and a vertically movable frame above said truck frame and generally over said rear axle, said mechanism comprising a longitudinally extending channel member secured to said truck frame on each side thereof, two arms pivotally connected at a center pivot at approximately their centers to form a scissors configuration, one end of one arm having a fixed pivotal connection with said truck frame and said channel members and the other end having a movable connection with said vertically movable frame, one end of the other of said arms having a fixed pivotal connection with said vertically movable frame and a movable connection with said truck frame and said channel members, an extensible power unit connected between said arms for spreading or closing said arms and thereby raising or lowering said movable frame relative to said truck frame, said power unit being connected to said arms at locations between said center pivot and said fixed pivotal connections, and longitudinally extending structural reinforcement means secured to said truck frame on each side thereof and extending from approximately said rear axle rearwardly to approximately the rearward end of said truck frame, said channel members being secured to said reinforcement means and said reinforcement means being shaped to strengthen said channel members and said truck frame against downward flexing, whereby said movable connection with said truck frame is supported by said channel members, by said reinforcement means, and by said truck frame.

2. A lift mechanism according to claim 1, wherein said power unit extends generally vertically and is longitudinally spaced from said center pivot.

3. A lift mechanism according to claim 2, wherein said power unit is spaced forwardly from said center pivot.

4. A lift mechanism according to claim 1, wherein each of said arms comprises a pair of laterally spaced beams, and laterally extending cross braces connecting said beams, said power unit being pivotally secured to said cross braces.

5. A lift mechanism according to claim 1, wherein said frame members change dimensions adjacent the rear wheels of the truck.

6. A lift mechanism according to claim 5, wherein said reinforcement means comprises a Z-shaped member at the rearward portion of said frame member and two angles at the forward portion of said frame member, said channel means being supported by said Z-shaped members and said angles.

7. Truck apparatus comprising front and rear axles, a truck frame mounted on said axles, a vertically movable frame above said truck frame and generally over said rear axle, a longitudinally extending channel member secured to said truck frame on each side thereof, two arms pivotally connected at a center pivot at approximately their centers to form a scissors configuration, one end of one arm having a fixed pivotal connection with said truck frame and said channel members and the other end having a movable connection with said vertically movable frame, one end of the other of said arms having a fixed pivotal connection with said vertically movable frame and a movable connection with said truck frame and said channel members, an extensible power unit connected between said arms for spreading or closing said arms and thereby raising or lowering said movable frame relative to said truck frame, said power unit being connected to said arms at locations between said center pivot and said fixed pivotal connections, and longitudinally extending structural reinforcement means secured to said truck frame on each side thereof and extending from approximately said rear axle rearwardly to approximately the rearward end of said truck frame, said channel members being secured to said reinforcement means and said reinforcement means being shaped to strengthen said channel members and said truck frame against downward flexing, whereby said movable connection with said truck frame is supported by said channel members, by said reinforcement means, and by said truck frame.

* * * * *